US008192139B2

(12) United States Patent
Peterson et al.

(10) Patent No.: US 8,192,139 B2
(45) Date of Patent: Jun. 5, 2012

(54) DUAL INLET REGENERATIVE AIR PUMP

(75) Inventors: Todd R. Peterson, New Boston, MI (US); Ketan Adhvaryu, Sterling Heights, MI (US); Kevin R. Liske, Sterling Heights, MI (US)

(73) Assignee: Borgwarner Inc., Auburn Hills, MI (US)

( * ) Notice: Subject to any disclaimer, the term of this patent is extended or adjusted under 35 U.S.C. 154(b) by 501 days.

(21) Appl. No.: 12/442,213

(22) PCT Filed: Nov. 6, 2007

(86) PCT No.: PCT/US2007/023340

§ 371 (c)(1),
(2), (4) Date: Mar. 20, 2009

(87) PCT Pub. No.: WO2008/057522

PCT Pub. Date: May 15, 2008

(65) Prior Publication Data

US 2010/0086396 A1 Apr. 8, 2010

Related U.S. Application Data

(60) Provisional application No. 60/856,954, filed on Nov. 6, 2006.

(51) Int. Cl.
*F04D 29/40* (2006.01)

(52) U.S. Cl. ..... 415/55.1; 415/182.1; 415/201

(58) Field of Classification Search ..... 415/55.1, 415/182.1, 201
See application file for complete search history.

(56) References Cited

U.S. PATENT DOCUMENTS 3,933,179 A * 1/1976 Hechler, IV ..... 137/635
4,921,400 A 5/1990 Niskanen
6,648,595 B2 11/2003 Laing

FOREIGN PATENT DOCUMENTS

JP 2006-522259 A 9/2006
KR 10-2005-0084274 A 8/2005

* cited by examiner

*Primary Examiner* — Jarrett Stark
*Assistant Examiner* — Nicholas Tobergte
(74) *Attorney, Agent, or Firm* — Warn Partners, P.C.

(57) ABSTRACT

The present invention relates to a pump arrangement (10) having a housing (12) and cover (14). The housing (12) and cover (14) form part of a pump mechanism (16). A first inlet or a housing inlet (26) is formed in the housing (12) and is connected to the pump mechanism (16). A second inlet or a cover inlet (28) is formed in the cover and is connected to the pump mechanism. The cover (14) also has a cover outlet (34) formed in the cover (14) that is connected to the pump mechanism (16) and is where fluid medium such as air flows out of the housing (12) arrangement. The use of two inlets increases the flow efficiency.

27 Claims, 4 Drawing Sheets

DUAL INLET REGENERATIVE AIR PUMP

CROSS-REFERENCE TO RELATED APPLICATIONS

This application claims the benefit of U.S. Provisional Application No. 60/856,954, filed Nov. 6, 2006.

FIELD OF THE INVENTION

The present invention relates to a housing arrangement for a pump.

BACKGROUND OF THE INVENTION

Pumps including secondary air pumps are used to control the flow of fluid medium or air to an engine. In particular secondary air pumps are used for the purpose of rapidly supplying outside air to the engine catalyst during an initial start in order to raise the catalyst temperature more quickly. Secondary air pumps generally have a housing and cover that have an inlet and outlet formed in the cover. The housing together with the cover form a flow path between the inlet and outlet. An actuator is connected to the housing and engages a fan member that rotates within the flow path between the inlet and outlet. Designing ways of increasing air flow through the pump arrangement is desirable because when the design of the housing and cover can promote greater flow than it will reduce stress on the actuator. Also increasing the flow will reduce the size of the actuator required for the pump arrangement.

SUMMARY OF THE INVENTION

The present invention relates to a pump housing arrangement having a housing and cover. The housing and cover form part of a pump mechanism. A first inlet or a housing inlet is formed in the housing and is connected to the pump mechanism. A second inlet or a cover inlet is formed in the cover and is connected to the pump mechanism. The cover also has a cover outlet formed in the cover that is connected to the pump mechanism and is where fluid medium such as air flows out of the pump housing arrangement. The use of two inlets increases the flow efficiency.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
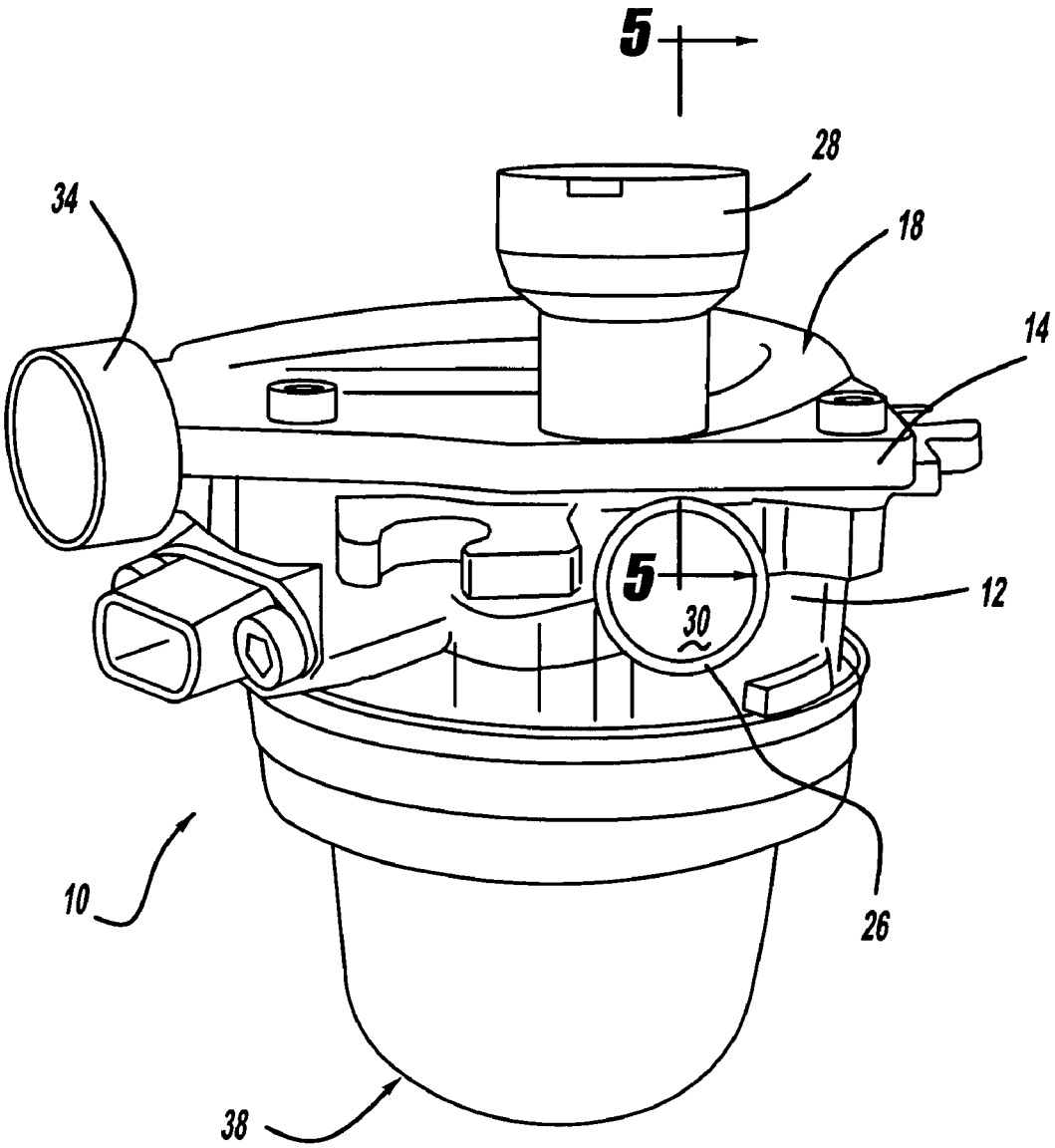
FIG. 1 is a perspective view of the pump housing arrangement.
Figure 2:
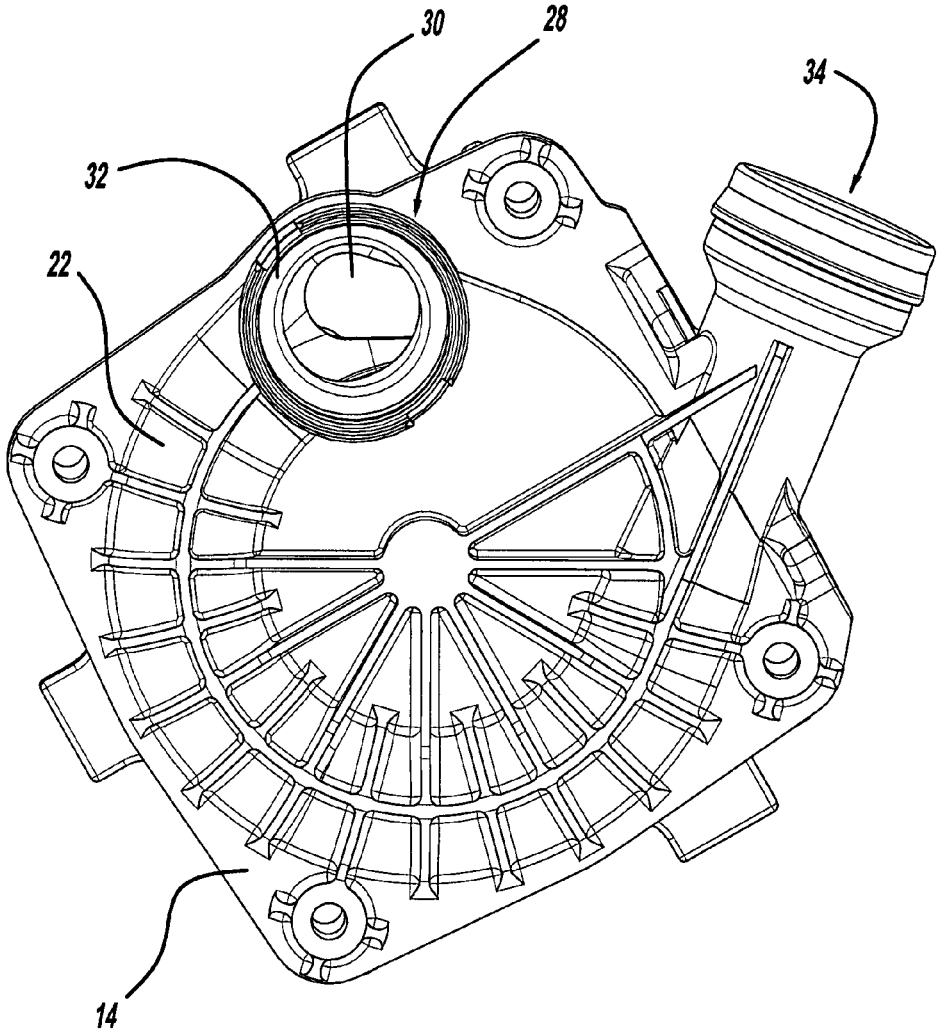
FIG. 2 is an overhead perspective view of the pump housing arrangement having the impeller removed.
Figure 3:
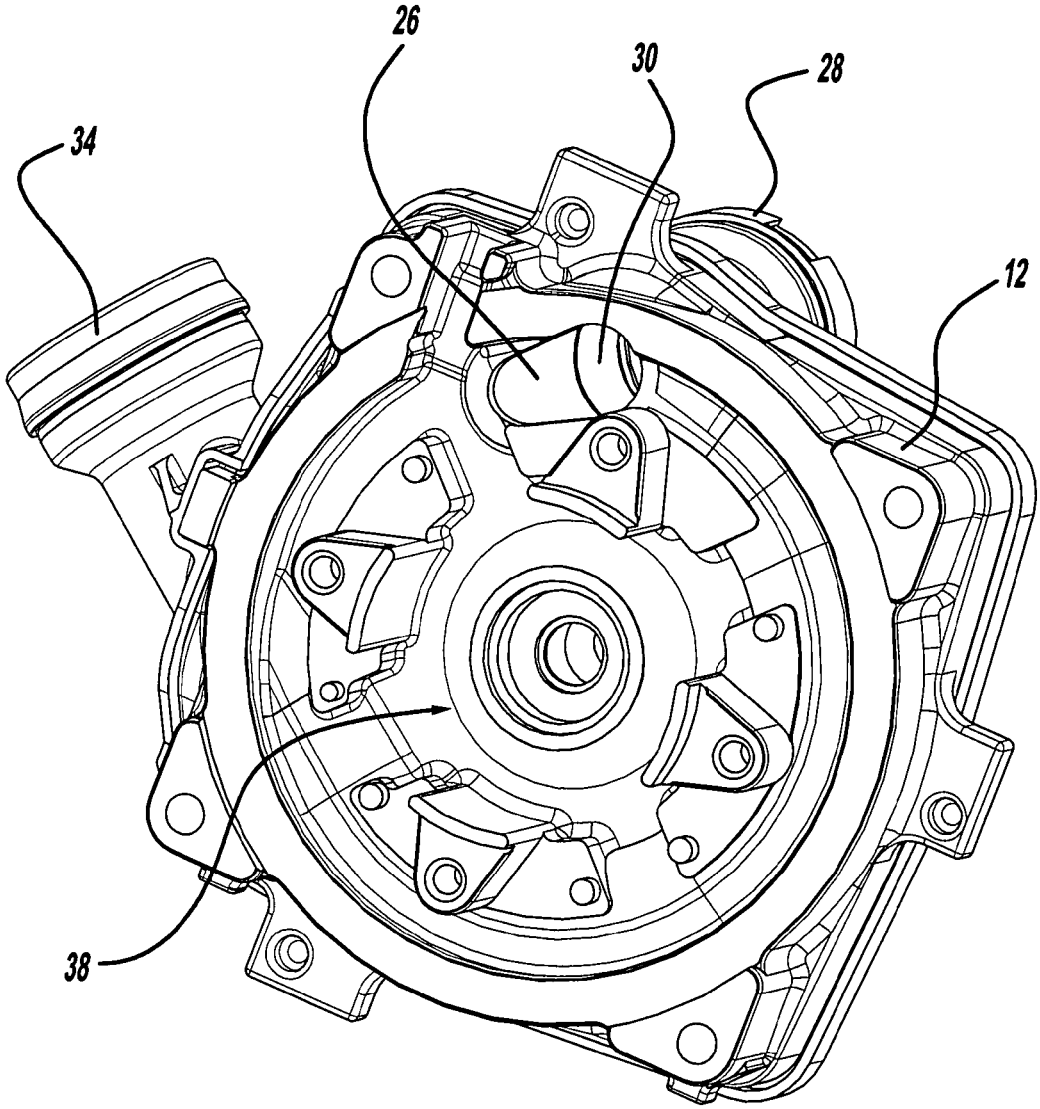
FIG. 3 is a bottom perspective view of the pump housing arrangement having the actuator components and portions of the housing removed.

The following description of the preferred embodiment(s) is merely exemplary in nature and is in no way intended to limit the invention, its application, or uses.

Referring generally to FIGS. 1-3 and 5, a pump arrangement 10 is shown. The pump arrangement 10 in the present invention can be a secondary air pump arrangement for use in supplying intake air to an engine exhaust catalyst during warm up. The pump arrangement 10 has a housing 12 that is generally formed of a metal casting. The housing 12 is connectable with a cover 14 to form the boundaries of a pump mechanism 16. The pump mechanism 16 causes air flow output from the pump arrangement 10. The pump mechanism 16 has a flow path 18 shown generally that is formed by a torus in the housing which is aligned with a torus 22 formed in the cover and extends between a housing inlet 26 and cover inlet 28 to an outlet or cover outlet 34. The cover outlet 34 can be formed in the cover, the housing or a combination of the cover and housing. It is also possible for the flow path to be formed by just a single torus on either the housing 12 or the cover 14.

An impeller 24 is contained within the housing 12 and cover 14 and also forms part of the pump mechanism 16. The impeller 24 is operably aligned with the toruses 20, 22 and functions to force air along the flow path 18. The impeller 24 can be a fan having blades or vanes or it can be some other suitable type of pump such as a disc with grooves. At a first end of the flow path 18 is the housing inlet 26 and cover inlet 28 which serve to introduce or draw air in to the pump mechanism 16.

The housing inlet 26 is connected to the torus on the housing, while the cover inlet 28 is connected to the torus 22 on the cover. However, both housing inlet 26 and cover inlet 28 supply air to the pump mechanism 16 as a whole. The housing inlet 26 and cover inlet 28 can be aligned in a juxtaposed manner or they can be offset from one another. The housing inlet 26 has an orifice 30 and cover inlet 28 has an orifice 32. The orifices 30, 32 have a surface area that defines the opening for air to flow into the pump mechanism 16. The orifices 30, 32 can vary in shape and size and are not necessarily equal. Varying the shape of the orifices 30, 32 can change the flow characteristics, also varying the orifices 30, 32 can change the volume of air that travels through the flow path 18. At a second end of the flow path 18 the cover outlet 34 is formed on the cover 14, however, the cover outlet 34 can be formed by portions of both the cover 14 and the housing 12 or wholly by just the cover or housing. The cover outlet 34 is where the output of the pump mechanism flows out of the pump arrangement 10.

Figure 4:
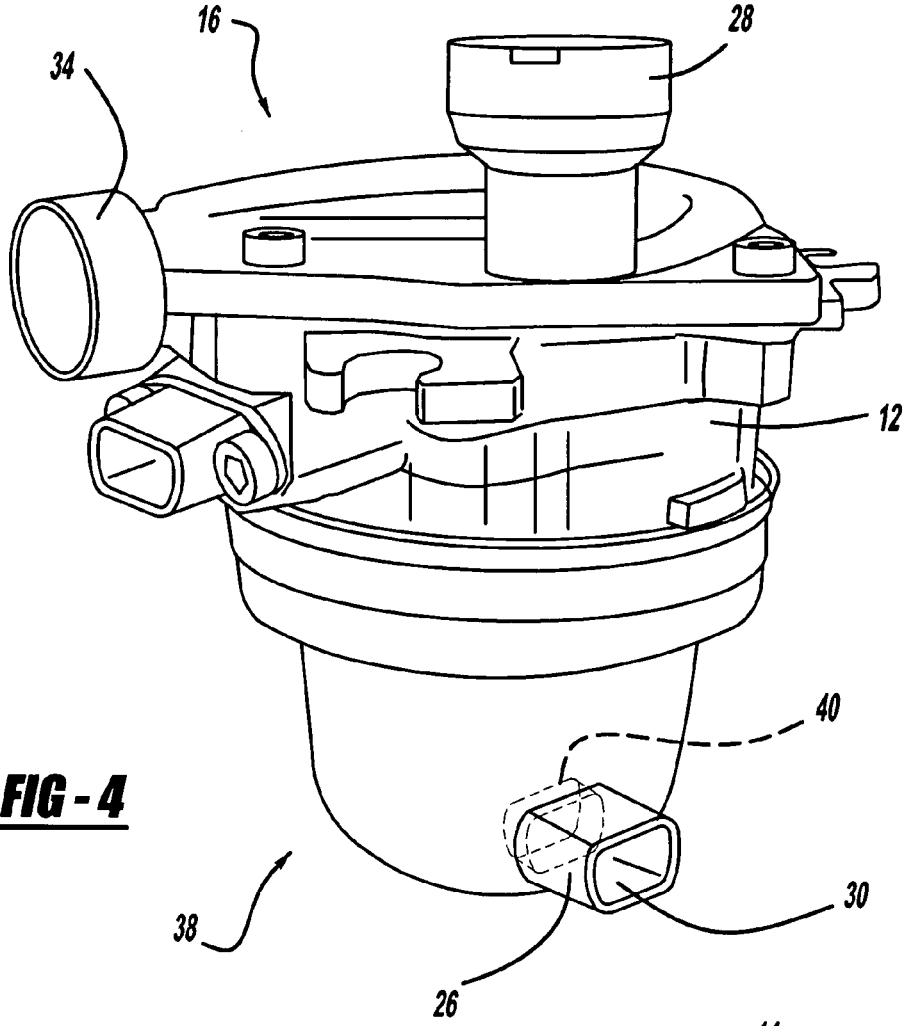
FIG. 4 is a perspective view of an alternate embodiment of the pump housing arrangement.
Figure 5:
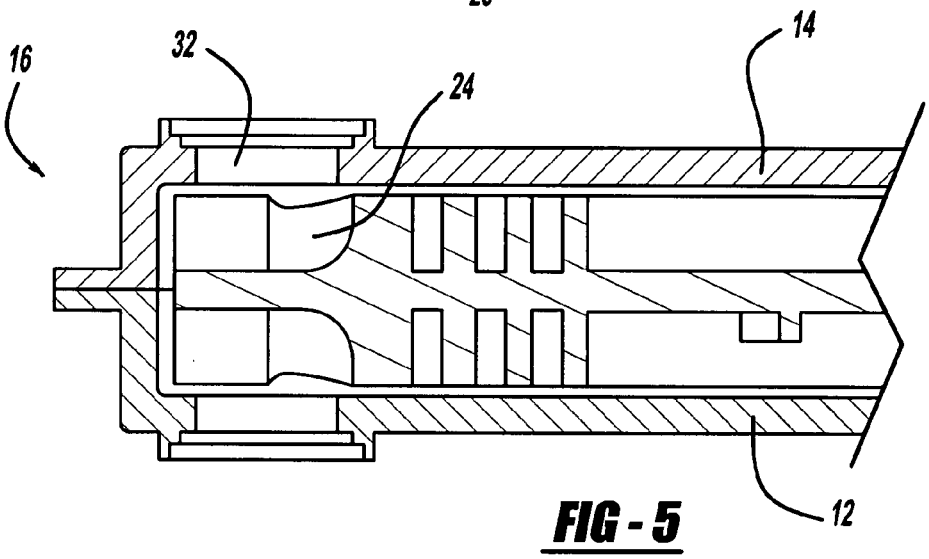
FIG. 5 is a cross sectional plan view of the pump housing arrangement.

The cover inlet 28 can be formed on the cover 14. The housing inlet 26 is formed within the housing 12. The housing inlet 26 can be connected to a flow passage that flows intake air through the housing 12 and introduces it via the housing inlet 26 to the pump mechanism 16. The flow passage can take many shapes or pathways through the housing 12. The housing can have an actuator chamber 38 for receiving an actuator (not shown) that is operably connected to the impeller 24 to move the impeller within the pump mechanism 16 in order to cause the flow of air between the housing inlet 26 and cover inlet 28 to the cover outlet 34. The actuator during normal operation can become fatigued over time due to overheating. One aspect of the present invention is to position the flow passage of the housing inlet 26 in a way that will cause intake air to flow through the actuator chamber past the actuator during operation of the pump arrangement 10. This will have a cooling effect 38, on the actuator and reduce the effects of overheating. In certain applications, as shown in FIG. 4, a filter 40 can be connected to the flow passage 36 to filter the air prior to flowing past the actuator 38. This will reduce the possibility of unwanted debris contaminating the actuator 38.

The pump arrangement 10 provides the advantage of increasing the surface areas of the amount of air inputted to the pump mechanism 16. This is accomplished by having two inlets, that is, the housing inlet 26 and the cover inlet 28 both will increase the amount of air intake. The result is that the output flow of the pump arrangement 10 is increased without having to increase the size of the actuator used on the pump arrangement.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A pump arrangement comprising:
a housing;
a cover, wherein said housing and said cover form part of a pump mechanism;
a housing inlet formed in said housing and connected to said pump mechanism;
a cover inlet formed in said cover and connected to said pump mechanism; and
an outlet connected to said pump mechanism, wherein said cover inlet and said housing inlet are aligned in a juxtaposed manner.

2. The pump of claim 1 wherein said cover inlet and said housing inlet each have an orifice with an area that is equal.

3. The pump of claim 1 wherein said cover inlet and said housing inlet each have an orifice with an area that is unequal.

4. A pump arrangement comprising:
a housing;
a cover, wherein said housing and said cover form part of a pump mechanism;
a housing inlet formed in said housing and connected to said pump mechanism;
a cover inlet formed in said cover and connected to said pump mechanism; and
an outlet connected to said pump mechanism, wherein said cover inlet and said housing inlet are offset.

5. The pump of claim 4 wherein said cover inlet and said housing inlet each have an orifice with an area that is equal.

6. The pump of claim 4 wherein said cover inlet and said housing inlet each have an orifice with an area that is unequal.

7. A pump arrangement comprising:
a housing;
a cover, wherein said housing and said cover form part of a pump mechanism;
a housing inlet formed in said housing and connected to said pump mechanism;
a cover inlet formed in said cover and connected to said pump mechanism;
an outlet connected to said pump mechanism,
an actuator connected to said housing; and
a flow passage connected to said housing inlet and extending past said actuator.

8. The pump of claim 7 further comprising a filter operably engaged to said flow passage.

9. A pump arrangement comprising:
a housing;
a cover, wherein said housing and said cover form part of a pump mechanism;
a housing inlet formed in said housing and connected to said pump mechanism;
a cover inlet formed in said cover and connected to said pump mechanism; and
an outlet connected to said pump mechanism, wherein said pump mechanism comprises a torus formed on said housing or said cover and an impeller operably positioned within said torus.

10. The pump arrangement of claim 9 wherein said pump mechanism has a torus formed on said cover and a torus formed on said housing, wherein both toruses are aligned to define the flow path of said pump mechanism.

11. A pump arrangement comprising:
a housing;
a cover, wherein said housing and said cover form part of a pump mechanism;
a housing inlet formed in said housing and connected to said pump mechanism;
a cover inlet formed in said cover and connected to said pump mechanism; and
an outlet connected to said pump mechanism, wherein said outlet is formed in one of said cover, said housing or combinations thereof.

12. A pump arrangement comprising:
a cover wherein said housing and said cover form part of a pump mechanism;
an actuator connectable to said housing;
a housing inlet formed in said housing and connected to said pump mechanism, wherein said housing inlet has a flow passage that flows fluid medium past said actuator to cool said actuator; and
an outlet formed in said cover and connected to said pump mechanism.

13. The pump housing arrangement of claim 12 further comprising a filter operably engaged to said flow passage.

14. The pump of claim 12 wherein said pump mechanism comprises a torus formed on said housing or said cover and an impeller operably positioned within said torus.

15. The pump of claim 12 wherein said pump mechanism has a torus formed on said cover and a torus formed on said housing wherein both toruses are aligned to define the flow path of said pump mechanism.

16. The pump arrangement of claim 12 wherein said outlet is formed in one of said cover, said housing or combinations thereof.

17. A secondary air pump arrangement comprising:
a housing having a torus and a moveable impeller positioned with respect to said torus;
a cover having a torus operably aligned with said torus of said housing, wherein said impeller is positioned with respect to said torus of said cover;
an actuator connected to said housing and operably connected to said impeller;
a housing inlet formed in said housing and operably connected to said torus of said housing and said torus of said cover;
a flow passage connected to said housing inlet and extending past said actuator to cool said actuator during operation;
a cover inlet formed in said housing and operably connected to said torus of said cover and said torus of said housing; and
a cover outlet formed in said cover and operably connected to said torus of said housing and said torus of said cover.

18. The pump of claim 17 wherein said cover inlet and said housing inlet are aligned in a juxtaposed manner.

19. The pump of claim 18 wherein said cover inlet and said housing inlet each have an orifice with an area that is equal.

20. The pump of claim 18 wherein said cover inlet and said housing inlet each have orifice with an area that is unequal.

21. The pump of claim 14 wherein said cover inlet and said housing inlet are offset.

22. The pump of claim 17 wherein said cover inlet and said housing inlet each have a orifice that is equal.

23. The pump of claim 21 wherein said cover inlet and said housing inlet each have an orifice with an area that is unequal.

24. The pump of claim 14 further comprising a filter operably engaged to said flow passage.

25. The pump of claim 17 wherein said outlet is formed in one of said cover, said housing or combinations thereof.

26. A pump arrangement comprising:

a housing;

a cover, wherein said housing and said cover form part of a pump mechanism;

a housing inlet formed in said housing and connected to said pump mechanism;

a cover inlet formed in said cover and connected to said pump mechanism;

an outlet connected to said pump mechanism;

a flow path in the housing and the cover, said flow path extending between said housing inlet and said cover inlet to said outlet;

an impeller contained within said housing and said cover; and wherein said cover inlet in said cover supplies fluid flow to said flow path in said cover and said inlet in said housing supplies fluid flow to said flow path in said housing.

27. The pump arrangement of claim 26 wherein said housing inlet in said housing and said cover inlet in said cover supply fluid flow to said flow path in said housing and said cover as a whole.

* * * * *